US005145030A

United States Patent [19]

Pavlescak et al.

[11] Patent Number: 5,145,030

[45] Date of Patent: Sep. 8, 1992

[54] GUARD RAIL POST

[75] Inventors: Jim J. Pavlescak, Middleburg Heights; Gary V. Anderson, Cleveland, both of Ohio

[73] Assignee: Waco International Corporation, Cleveland, Ohio

[21] Appl. No.: 757,719

[22] Filed: Sep. 11, 1991

[51] Int. Cl.[5] ..... E04G 1/26; E04G 1/14

[52] U.S. Cl. ..... 182/113; 182/178

[58] Field of Search ..... 182/113, 178, 179; 256/59

[56] References Cited

U.S. PATENT DOCUMENTS

| | | | |
|---|---|---|---|
| 2,906,551 | 9/1959 | May . | |
| 3,071,206 | 1/1963 | Kristen | 182/179 |
| 3,270,997 | 9/1966 | Gethmann | 182/113 |
| 3,382,949 | 5/1968 | Bloch | 182/113 |
| 3,432,147 | 3/1969 | Schreyer et al. . | |
| 3,747,898 | 7/1973 | Warren . | |
| 3,752,262 | 8/1973 | Helms | 182/178 |
| 3,863,899 | 2/1975 | Werner . | |
| 3,863,900 | 2/1975 | Dagiel et al. . | |
| 3,920,221 | 11/1975 | Berry et al. . | |
| 3,938,619 | 2/1976 | Kurabayashi et al. . | |
| 4,301,627 | 11/1981 | Wilson . | |
| 4,597,472 | 7/1986 | Hjelm | 182/179 |
| 4,666,131 | 5/1987 | Kettelkamp, Sr. et al. . | |
| 4,669,557 | 6/1987 | Werner . | |
| 4,782,914 | 11/1988 | Nail | 182/179 |
| 4,858,724 | 8/1989 | St-Germain . | |

*Primary Examiner*—Reinaldo P. Machado

*Attorney, Agent, or Firm*—Pravel, Gambrell, Hewitt, Kimball & Krieger

[57] ABSTRACT

This invention provides a guard rail post for use on scaffolding of the type used in the construction of buildings. The guard rail post comprises an elongated member having securing means for securing the guard rail post to a vertical support member of the scaffold, positioning means for mounting the guard rail post in fixed relationship to a scaffold work platform and means for connecting guard rails to the post at a fixed distance above the work platform.

14 Claims, 3 Drawing Sheets

GUARD RAIL POST

FIELD OF THE INVENTION

This invention relates to fall prevention devices for use on scaffolds. More particularly this invention provides a means for mounting guard rails on the work platforms of a tubular frame scaffold of the type commonly used in the construction of buildings.

BACKGROUND OF THE INVENTION

In the construction of buildings it is often necessary to provide an elevated platform alongside the building to enable work to be done on the building's exterior. Tubular frame scaffolding was developed for this purpose. Much effort has been put into the design of these types of scaffold to make them easy to transport and assemble. The scaffold arrives at the construction site in prefabricated U-shaped trusses. These trusses typically have two horizontal members connecting two pairs of spaced apart uprights, each pair of uprights having an inner and an outer vertical member. These trusses are inverted to form the vertical supports of the scaffold. The outer vertical member of each truss has an upper end portion of reduced diameter for insertion into the lower end portion of another truss, which allows the U-shaped trusses to be stacked into towers.

Cross braces connect the individual towers and provide lateral stability. When properly stabilized, scaffolds can be constructed which rise 10 stories or more above ground, without danger of collapse. Wooden boards may be placed across the upper horizontal members of two horizontally adjacent trusses to provide a work platform. This design enables work to be done at any level of the scaffolding. A scaffold can also be horizontally expanded by extending cross braces and work platforms from one truss to another ad infinitum. In this manner, a scaffold can be made to span an entire wall.

Without some form of fall prevention, scaffolds of this type would be extremely hazardous places to work since they are essentially open platforms. Some fall prevention mechanism is needed. Unfortunately, the methods most commonly used to protect workers from falling have not kept pace with scaffolding itself in terms of ease of transportation and assembly. Wire mesh screens are sometimes used but are time consuming and labor intensive to install. They are equally difficult to remove, and once removed are bulky to transport for disposal or reuse. If not reused, the consumption of wire mesh screens becomes costly.

Guard rails are another form of barrier to protect workers. Guard rails made of lumber are sometimes used but they are clumsy, not always sturdy, and must be wired into place—a time consuming process. Metal guard rails are sometimes used. They are more sturdy than wood rails or wire mesh, but typically must be clamped onto the scaffold. Clamps and their associated nuts and bolts are prone to being lost in the chaotic environment of a construction site.

In addition, whether the guard rails are wood or metal, they must be positioned an appropriate distance above the work platform to make them at all effective for fall prevention. At present, Federal and several state agencies have adopted rules that specify the location of guard rails on scaffold work platforms, mandating that rails be placed at heights of 21 inches and 42 inches above each work platform. These regulations make it increasingly important to provide guard rail assemblies which can be easily assembled and accurately positioned above a work platform.

One guard rail assembly is disclosed in U.S. Pat. No. 3,752,262 to Helms. The Helms assembly includes vertical posts which must be inserted over the free end of a truss, with the rails then being mounted between the posts by way of brackets which are premounted on the posts. Because it must be mounted over the free end of a truss, the Helms assembly can only be used above the uppermost platform and is not suitable for use with a multiplatform scaffold.

U.S. Pat. No. 4,782,914 to Nail also discloses a guard rail assembly but it is a complex and bulky system. The Nail system involves multiple cross-brace members and rails pivotally and slideably mounted to one another. The Nail device must be positioned by a U-shaped clamp that engages a rung included on the outer vertical member of some construction scaffold designs. Only one guard rail clamp can be properly positioned on each truss rung above a work platform and only one guard rail can be attached to each clamp. Consequently, the Nail device is ill suited for use on a work platform spanning three or more truss towers since two guard rails must be attached to the middle truss. In addition, location of the rail depends on the location of a truss rung which may or may not be a suitable location for compliance with regulations on for safety.

It would therefore be desirable to have a guard rail assembly which can be used above any intermediate platform of a multiplatform scaffold, which can locate the guard rails at one or more proper heights above a work platform, independently of locations of other scaffold parts and is economical to transport and assemble without the need for separate small pieces like nuts, bolts, and clamps that are easily lost in the chaotic environment of a construction site.

SUMMARY OF THE INVENTION

This invention provides a guard rail assembly which can be positioned above a work platform at any level of a scaffold, for positioning one or more guard rails at predetermined heights above the platform. The invention includes a guard rail post for attachment to a vertical member of a scaffold which incorporates connecting means for releasably securing the guard rail post substantially perpendicular to a vertical member of the scaffold and positioning means to mount the guard rail post in a predetermined relation to the work platform. The invention further provides connecting means on the guard rail post for releasably locking guard rails at fixed distances along the length of the guard rail post and above the working platform. These attachment means are suitable for securing one or more guard rails to the guard rail post which enables the use of this invention on a multiple truss tower scaffold with a long work platform.

DETAILED DESCRIPTION OF A PREFERRED EMBODIMENT

Figure 2:
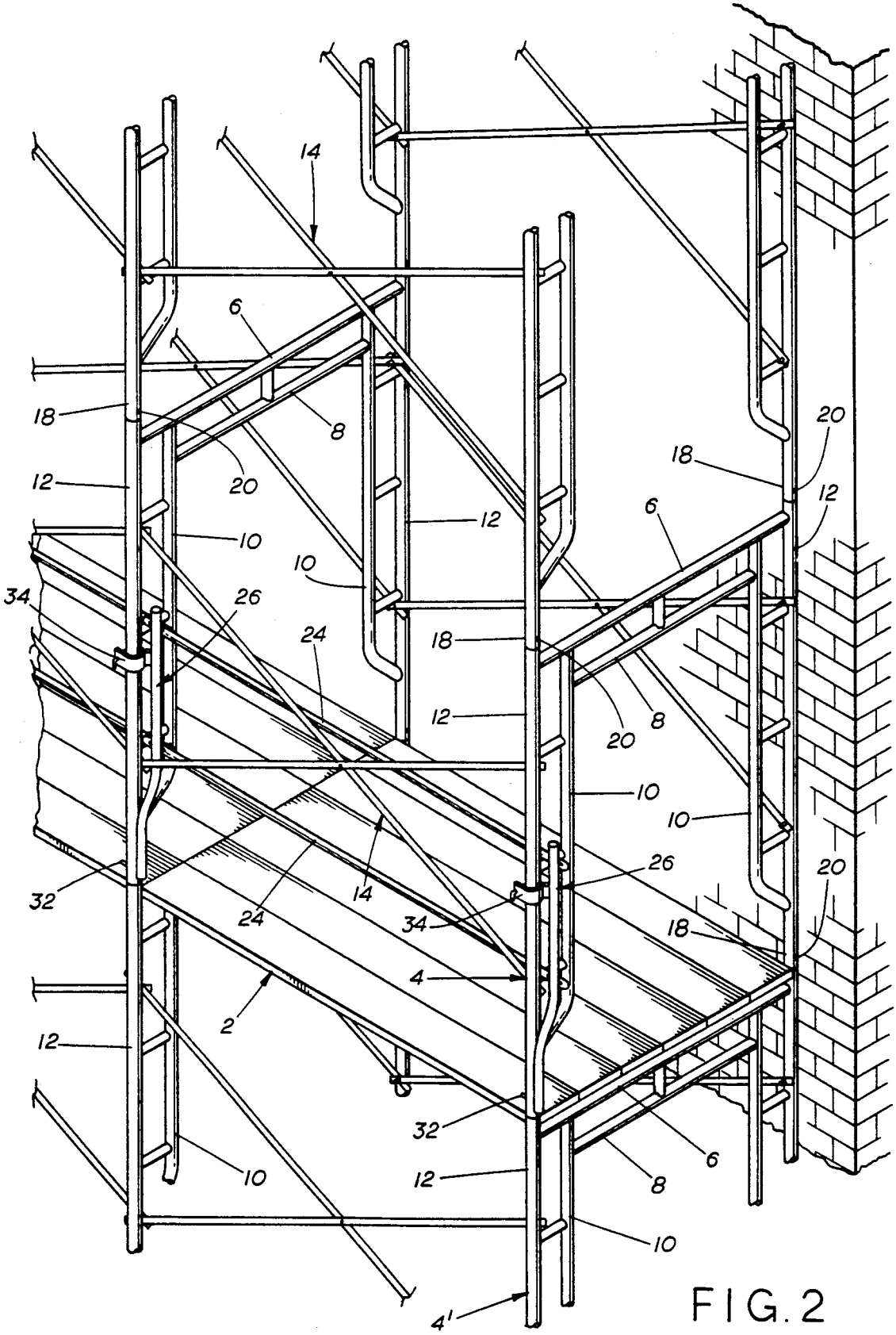
FIG. 2 is a perspective view of a scaffold illustrating the guard rail assembly of the instant invention attached for use on a typical multi-truss scaffold.
Figure 3:
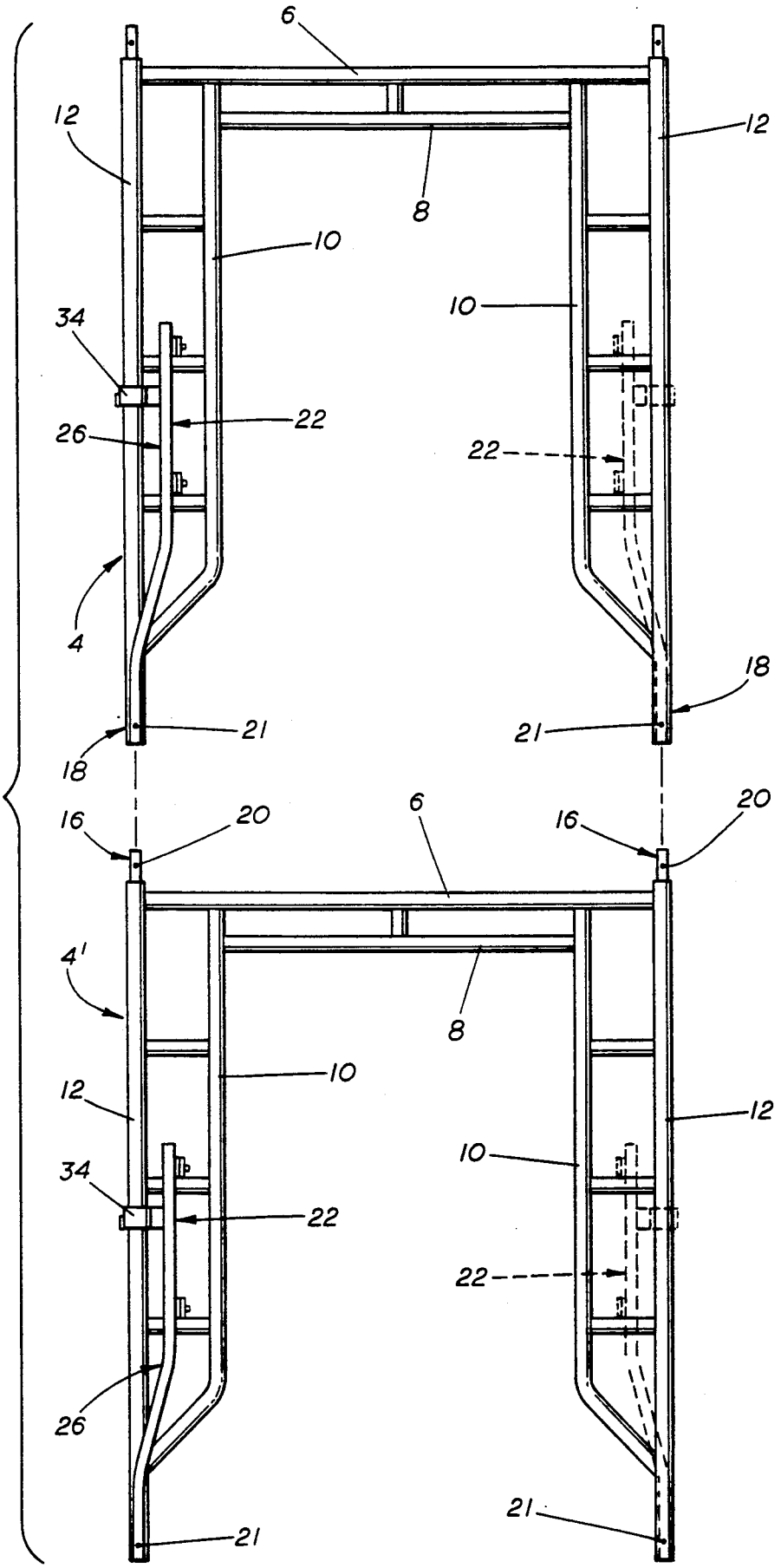
FIG. 3 is an exploded view of a two level truss tower having guard rail posts of the instant invention positioned for use.

In FIG. 2, there is illustrated a work platform 2 positioned on a multi-truss scaffold. The scaffold is composed of a plurality of inverted U-shaped trusses such as 4 and 4' each having a pair of spaced apart vertical uprights connected by horizontal connecting members 6 and 8 as best seen in FIG. 3, wherein the same numerals refer to corresponding parts in trusses 4 and 4'. Each vertical upright of the scaffold truss includes an inner and an outer vertical member 10 and 12, respectively. Scaffold cross braces 14 interconnect the U-shaped trusses and give lateral stability to the scaffold.

According to the standard design in the construction industry, the outer vertical members 12 of the U-shaped truss are provided with truss connecting members for stacking the U-shaped trusses into towers. Truss connecting members typically include a reduced diameter segment 16 at the upper end of the outer vertical member of a truss 4'. The reduced diameter segment 16 is sized to fit into the lower portion 18 of the outer vertical member 12 of another truss 4 as shown in FIG. 2. To secure the trusses together, the interlocking segments 16 and 18 are typically provided with holes, 20 and 21, respectively, for receiving a locking pin.

As illustrated in FIG. 3, reduced diameter segment 16 fits within lower portion 18 to form a stacked tower mounted atop the bottom truss 4. Work platforms, such as platform 2 in FIG. 2, are typically secured to the upper horizontal truss member 6. This method of attaching the work platform to a truss results in the work platform being positioned at a fixed height relative to the pin receiving holes 21.

Turning to the features of the present invention, the guard rail assembly (best shown in FIG. 1) is generally designated 22. The assembly 22 includes horizontally extending guard rails 24 positioned at fixed distances above the work platform 2 by means of a guard rail post 26 for attachment to the outer vertical member 12 of a scaffold. The guard rail post 26 is adapted for mounting guard rails 24 in substantially horizontal position between the vertical uprights of horizontally adjacent U-shaped trusses.

Figure 1:
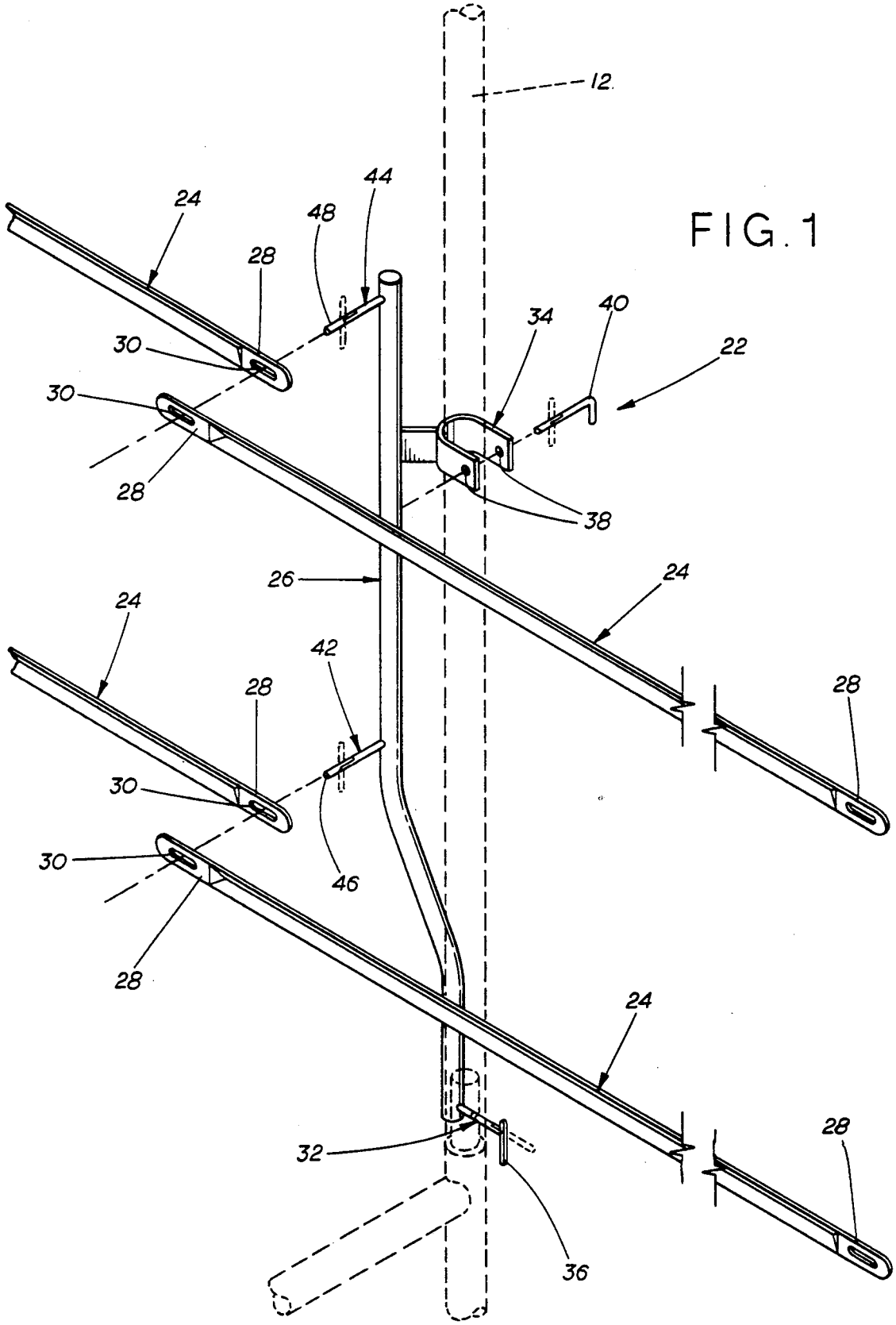
FIG. 1 is a detailed exploded view of an illustrative embodiment of the instant invention showing the guard rails and guard rail post of the assembly.

Particularly shown in FIG. 1, as practiced, the guard rails 24 are constructed of extruded steel having a U-shaped or V-shaped cross section to increase resistance to bending. For additional strength, particularly for use with long platforms, three inch segments 28 at each end of the guard rail are preferably folded together. Within the folded segments two apertures 30 are drilled through the guard rail for attachment to the guard rail post, 26. The distance between the apertures along the guard rail is predetermined by the spacing distance between the scaffold towers. Spacing distance is determined by the cross bracing. The apertures 30 may be any shape, but horizontally extending slots as illustrated are preferred for ease of assembly and to allow for minor variation in distance between the towers. An Alternative to allowing for variations between towers is to use guard rails of adjustable length which may be constructed in a manner known to the art, such as by using two telescoping or adjustably clamped half-rails.

As shown in FIG. 2, each guard rail is supported by one or more guard rail posts 26 which are secured to the scaffold support members by post securing means. The post securing means includes, but is not limited to, a lower post securing means and an upper post securing means. The lower post securing means is located adjacent to the lower end of the guard rail post. Any suitable means for securing the post at the lower end can be used such as clamps or brackets. As best shown in FIG. 1, in the preferred embodiment, the lower securing means includes a post pin 32, sized to fit through the existing scaffold holes 20, 21 in the interlocking segments 16 and 18. The post pin is provided with a fliplock 36 to releasably lock the guard rail post to a vertical scaffold member such as the outer member 12 in FIG. 2. Although in the illustrated embodiment the post pin 32 is locked to the scaffold with a fliplock 36, other types of locking mechanisms such as can be appreciated by one of ordinary skill in the art could be used, such as a threaded post pin and a locking nut.

The lower post securing means cooperates with the upper post securing means to secure the guard rail post alongside the outer vertical support member 12 of the scaffold to prevent pivoting or rotation of the post when the guard rails are impacted. The upper post securing means is preferably located substantially closer to the upper end of the guard rail post than to its lower end to improve stability. In the illustrated embodiment, the upper post securing means includes a U-shaped channel 34 mounted on the guard rail post 26 so it will align with the outer vertical scaffold member 12 when the guard rail post is secured to the outer vertical scaffold member at the lower end. With this arrangement, the guard rail post is aligned alongside and substantially parallel to the outer vertical scaffold member 12.

The U-shaped channel is preferably provided with a pair of opposing holes 38 for receiving a locking pin 40 to releasably lock the U-shaped channel and vertical scaffold member into engagement. In the preferred embodiment, locking pin 40 is likewise equipped with a fliplock similar to the fliplock 36 for the lower post correcting means for ease of installation and removal. To avoid the problem of lost parts, the locking pin 40 is preferrably attached to the guard rail post in some way, as for instance by chain.

Although in the illustrated embodiment, the U-shaped channel 34 aligns with the outer vertical scaffold member 12, one of ordinary skill in the art can appreciate that the U-shaped channel could be positioned to align with the inner vertical scaffold member 10.

A guard rail connecting means is provided for securing the guard rails 24 to the guard rail post 26. With reference to FIG. 1, in the illustrated embodiment, a lower guard rail pin 42 and an upper guard rail pin 44. extending from the post 26 at the predetermined rail height are provided for connection with the rail apertures 30 at each end Of the guard rail. When using guard rails made according to the illustrated embodiment, two or more guard rails can be mounted on each pin. This feature allows a guard rail assembly to be extended along a work platform spanning three or more truss towers. For example, on a scaffold where three truss towers support a work platform, guard rails can be made to span the work platform using four guard rails and three guard rail posts, the middle post of the assembly having all four guard rails mounted thereon. For the purpose of mounting two or more guard rails on a single guard rail pin, these pins are preferably 2¼ inches long or greater. The guard rail pins are provided with flip locks 46 and 48 to releasably lock the guard rails to the guard rail post. Alternatively, the guard rails could be connected using clamps or brackets.

As can be appreciated, some clearance between the guard rails and the vertical members of the scaffold is necessary for ease in mounting the rails on the rail pins 42 and 44. This clearance is preferably accomplished by providing a guard rail post having a horizontal offset between the post pin 32 and the lower guard rail pin 42. As practiced with the guard rail post constructed of hollow metal tubing, this clearance is accomplished by bending the post 26 so that it has two opposing bends of like degree. In this manner, when fixed to the scaffold by the upper post securing means and lower post securing means, the lower portion of the post can abut the outer vertical scaffold member for secure mounting and the upper portion of the post can be spaced from the support so that the vertical members of the scaffold do not interfere with or contact the guard rails during or after assembly.

As can also now be appreciated, accurate positioning of a guard rail post above a work platform is accomplished with the present invention by locating the lower post securing pin 32 of the guard rail post assembly 22 so that it can be used in lieu of the pin normally used to interlock levels of scaffold trusses. Because the truss interlocking holes 20 and 21 are in a fairly standard location for typical scaffolds, the guard rail pins 42 and 44 can be located a suitable predetermined distance on the post above the lower post securing pin 32 to assure that the rails will be positioned at the proper location above the work platform 2 for both safety and compliance with applicable regulations.

With this basic design of the post securing means and rail connecting means, the guard rail post can be used not only on a long parallel to scaffold platform but also on the ends of a platform by making suitable changes in the relationship of the various elements of the guard rail post—e.g. post pin, U-shaped channel, and guard rail pins—or by mounting these elements on appropriately spaced rotatable collars.

As can now be appreciated, the invention is not limited to the illustrated embodiment and various changes can be made in the arrangement and design of the guard rail post assembly of the present invention without departing from the spirit of the invention, the scope of which is defined by the following claims.

What is claimed is:

1. A guard rail post for use on a construction scaffold comprising:

a) means for securing the post alongside a vertical scaffold support member;

b) means for positioning the post at a predetermined location relative to a scaffold work platform, wherein the positioning means includes a pin for insertion into an existing hold in a scaffold truss, and;

c) means for connecting a guard rail to the guard rail post in a predetermined position above the scaffold work platform.

2. The guard rail post of claim 1 wherein the post securing means includes an upper and a lower securing means and wherein the post positioning means includes the lower post securing means.

3. The guard rail post of claim 1 wherein the scaffold is constructed of trusses having means for connecting an underlying truss to an overlying truss and wherein the post positioning means includes the means for securing the post to a vertical member of the underlying truss.

4. The guard rail post of claim 1 wherein the post securing means includes a U-shaped channel sized to engage a vertical scaffold truss member.

5. The guard rail post of claim 1 wherein the means for connecting a guard rail to the guard rail post includes a clamp secured to the post predetermined location.

6. The guard rail post of claim 1 wherein the means for connecting a guard rail to the guard rail post includes a bracket secured to the post at a predetermined location.

7. The guard rail post of claim 2 wherein the means for positioning the guard rail post further includes the means for connecting a guard rail to the guard rail post.

8. A guard rail post for use on a construction scaffold comprising:

a) means for securing the post alongside a vertical scaffold support member;

b) means for positioning the post at a predetermined location relative to a scaffold work platform, and;

c) means for connecting a guard rail to the guard rail post including a pin secured to the post at a predetermined location.

9. The guard rail post of claim 8 wherein the post securing means includes an upper and a lower securing means and wherein the post positioning means includes the lower post securing means.

10. The guard rail post of claim 8 wherein the scaffold is constructed of trusses having means for connecting an underlying truss to an overlying truss and wherein the post positioning means includes the means for securing the post to a vertical member of the underlying truss.

11. The guard rail post of claim 8 wherein the post securing means includes a U-shaped channel sized to engage a vertical scaffold truss member.

12. The guard rail post of claim 8 wherein the means for connecting a guard rail to the guard rail post further includes a clamp secured to the post at a predetermined location.

13. The guard rail post of claim 8 wherein the means for connecting a guard rail to the guard rail post further includes a bracket secured to the post at a predetermined location.

14. The guard rail post of claim 8 wherein the means for positioning the guard rail post further includes the means for connecting a guard rail to the guard rail post.

* * * * *